US008573943B2

(12) United States Patent
Bilstein et al.

(10) Patent No.: US 8,573,943 B2
(45) Date of Patent: Nov. 5, 2013

(54) GAS TURBINE HAVING SEALING PLATES ON THE TURBINE DISC

(75) Inventors: Björn Bilstein, Essen (DE); Peter Schröder, Essen (DE)

(73) Assignee: Siemens Aktiengesellschaft, München (DE)

( * ) Notice: Subject to any disclaimer, the term of this patent is extended or adjusted under 35 U.S.C. 154(b) by 376 days.

(21) Appl. No.: 13/126,782

(22) PCT Filed: Sep. 4, 2009

(86) PCT No.: PCT/EP2009/061462

§ 371 (c)(1), (2), (4) Date: Apr. 29, 2011

(87) PCT Pub. No.: WO2010/049196

PCT Pub. Date: May 6, 2010

(65) Prior Publication Data

US 2011/0206524 A1 Aug. 25, 2011

(30) Foreign Application Priority Data

Oct. 30, 2008 (EP) ..... 08018988

(51) Int. Cl.
*F01D 5/30* (2006.01)

(52) U.S. Cl.
USPC ..... 416/219 R

(58) Field of Classification Search
USPC ..... 416/219 R, 219 A, 220 A, 220 R, 221, 416/248
See application file for complete search history.

(56) References Cited

U.S. PATENT DOCUMENTS

| | | | | |
|---|---|---|---|---|
| 5,257,909 | A | 11/1993 | Glynn et al. | |
| 5,281,098 | A | 1/1994 | Glynn et al. | |
| 5,713,721 | A | 2/1998 | Glynn et al. | |
| 7,566,201 | B2 * | 7/2009 | Brillert et al. | 416/221 |
| 2008/0181767 | A1 | 7/2008 | Brillert et al. | |

FOREIGN PATENT DOCUMENTS

| | | | |
|---|---|---|---|
| DE | 1401452 | A1 | 12/1961 |
| EP | 1498579 | A1 | 1/2005 |
| EP | 1650406 | A2 | 4/2006 |
| EP | 1944471 | A1 | 7/2008 |

* cited by examiner

*Primary Examiner* — Richard Edgar

(57) ABSTRACT

A turbine rotor having a plurality of rotor blades assembled into rotor blade rows and arranged on a turbine disk is provided. The respective turbine disc on the side surfaces thereof includes a plurality of sealing plates having edges that are arranged radially towards the inside, enables a simplified design and assembly, while maintaining maximum operational reliability and maximum efficiency of a turbine equipped therewith. Therefore, between the edge of the respective sealing plate and a side wall of the turbine disc groove, a closure member is provided, wherein the edge extends over the entire azimuthal length of the sealing plate and the closure members abut each other in the azimuthal direction for sealing purposes. The closure members may be inserted into the turbine disc groove via a recess interrupting the respective edge and extending substantially azimuthally on the side facing the turbine axis.

12 Claims, 6 Drawing Sheets

30
50
52
52
47
52
52

30
50
54
47

30
50
56
52
47

34
58

34
58
60

34
58
56

GAS TURBINE HAVING SEALING PLATES ON THE TURBINE DISC

CROSS REFERENCE TO RELATED APPLICATIONS

This application is the US National Stage of International Application No. PCT/EP2009/061462, filed Sep. 4, 2009 and claims the benefit thereof. The International Application claims the benefits of European Patent Office application No. 08018988.9 EP filed Oct. 30, 2008. All of the applications are incorporated by reference herein in their entirety.

FIELD OF THE INVENTION

The invention relates to a turbine rotor having a number of rotor blades which are combined in each case to form rotor blade rows and are arranged on in each case one turbine disk, the respective turbine disk having, on its side faces, a number of sealing plates in the shape of circularly annular sections which are inserted into an azimuthally extending turbine disk groove, the respective sealing plate having, on the side which faces the turbine axle, an azimuthally extending edge which is spaced apart from the inner edge of the respective sealing plate.

BACKGROUND OF INVENTION

Gas turbines are used in many fields for driving generators or mobile machines. Here, the energy content of a fuel is used to generate a rotational movement of a turbine rotor. To this end, the fuel is burned in a combustion chamber, air being fed in which has been compressed by an air compressor. Here, the operating medium which is produced in the combustion chamber by the combustion of the fuel and is under high pressure and at high temperature is fed via a turbine unit which is connected behind the combustion chamber and where said operating medium is relieved so as to do work.

Here, in order to generate the rotational movement of the turbine rotor, a number of rotor blades which are usually combined to form blade groups or blade rows are arranged on said turbine rotor. Here, a turbine disk is usually provided for each turbine stage, to which turbine disk the rotor blades are fastened by means of their blade root. In addition, in order to guide the flow of the operating medium in the turbine unit, guide blades which are connected to the turbine housing and are combined to form guide blade rows are usually arranged between adjacent rotor blade rows.

The combustion chamber of the gas turbine can be configured as what is known as an annular combustion chamber, in which a multiplicity of burners which are arranged around the turbine rotor in the circumferential direction open into a common combustion chamber space which is surrounded by a surrounding wall which is resistant to high temperatures. To this end, the combustion chamber in its entirety is configured as an annular structure. Besides a single combustion chamber, a plurality of combustion chambers can also be provided.

The combustion chamber is as a rule adjoined immediately by a first guide blade row of a turbine unit which, together with the immediately following rotor blade row as viewed in the flow direction of the operating medium, forms a first turbine stage of the turbine unit, behind which first turbine stage further turbine stages are usually connected.

In the design of gas turbines of this type, a particularly high degree of efficiency is usually a design target in addition to the power output which can be achieved. Here, an increase in the degree of efficiency can be achieved for thermodynamic reasons in principle by an increase in the outlet temperature, at which the operating medium flows out of the combustion chamber and into the turbine unit. Here, temperatures of approximately from 1200° C. to 1500° C. are aimed for and also achieved for gas turbines of this type.

At high temperatures of this type of the operating medium, however, the components and elements which are exposed to them are exposed to high thermal loadings. In order to protect the turbine disk from contact with hot operating medium and in order to guide cooling air along the side faces of the rotor disk to the rotor blades, sealing plates are usually provided on the turbine disks, which sealing plates are attached to the side faces, which are perpendicular in each case with respect to the turbine axle, such that they extend around circularly.

Here, in each case one sealing plate is usually provided per turbine blade on each side of the turbine disk. Said sealing plates overlap in an imbricated manner and usually have a sealing vane which extends as far as the respectively adjacent guide blade in such a way that a penetration of hot operating medium in the direction of the turbine rotor is avoided.

However, the sealing plates also fulfill further functions. They form firstly the axial fixing of the turbine blades by corresponding fastening elements, and secondly they not only seal the turbine disk against penetration of hot gas from the outside, but also avoid the escape of cooling air which is guided in the interior of the turbine disk and is usually guided further into the turbine blades to cool the latter. A gas turbine in a refinement of this type is known, for example, from EP 1 944 471 A1.

The abovementioned refinement of the turbine disks with sealing plates which overlap in a segmented and imbricated manner is relatively complicated, however. A relatively large number of sealing plates are required, which leads to a comparatively high construction outlay of the turbine disks and therefore of the entire gas turbine. Furthermore, a possibly required repair in the region of the turbine disks can be comparatively complicated as a result of this construction.

In addition, US 2008/0181767 A1 has disclosed a securing means for sealing sheets of turbine disks, in which securing means the sealing sheets have a shoulder on their inner edge, with which shoulder they bear sealingly against a laterally circumferential projection of the turbine disk. In order to secure the sealing sheets in their final installation position, in each case one closure element is required which, arranged in a recess of the sealing sheet, is inserted at the same time as said sealing sheet into the turbine disk groove. Subsequently, the closure element is removed from the recess and displaced along the turbine disk groove, said closure element then locking the sealing sheet radially and axially onto the turbine disk. In order to secure the closure piece against a displacement in the circumferential direction, its pointer is bent in between two cams which are provided on the sealing sheet. Overall, however, the simultaneous insertion of the sealing sheet and closure element is not easy to install.

SUMMARY OF INVENTION

The invention is therefore based on the object of specifying a turbine rotor which permits a simplified construction and mounting with maintenance of the highest possible operational security and the highest possible degree of efficiency when used in a turbine.

According to the invention, this object is achieved by way of a turbine rotor which is mentioned in the introduction and in which a closure piece is arranged between the edge of the respective sealing plate and a side wall of the turbine disk groove, and in which the edge extends over the entire azimuthal length of the sealing plate and the closure pieces bear against one another in the azimuthal direction for sealing purposes, the respective sealing plate comprising at least one recess which extends substantially azimuthally on the side which faces the turbine axle, interrupts the respective edge and is designed geometrically in such a way that the closure pieces can be inserted into the turbine disk groove through said recess.

Here, the invention proceeds from the consideration that a simplified construction of the gas turbine would be possible, in particular, in the region of the turbine disks if the construction which was previously customary could be simplified with sealing plates which are arranged in an overlapping manner.

Holes were made in the previously customary sealing plates which were arranged in an overlapping manner, with the result that said sealing plates could be fixed on the turbine disk by way of securing pins and securing sheets. In the case of a smaller number of sealing plates which are used, the individual sealing plates are larger, however. Multiple fastening over a greater area of the sealing plates on the turbine disk is therefore necessary, in order to ensure sufficient axial and radial fixing. Furthermore, the fastening is also to ensure a seal of the remaining gap between the turbine disk and the inner edge (that is to say, the edge which faces the turbine axle) of the sealing plate. To this end, the respective sealing plate has, on the side which faces the turbine axle, an edge which extends azimuthally and is spaced apart from the inner edge of the respective sealing plate, a plurality of closure pieces which bear against one another being arranged, such that they can be displaced azimuthally during mounting, between the edge and a likewise azimuthally extending turbine disk groove on the turbine disk for sealing purposes.

In this way, a plurality of closure pieces, for example in a bar shape, can be introduced into the remaining intermediate space between the sealing plate and the turbine disk. Said closure pieces are fixed in the radial and axial directions by the edge, sealing plate and side wall of the turbine disk groove. However, they remain displaceable in the azimuthal direction and can be arranged so as to bear against one another, in order to achieve a complete seal with the formation of a ring of closure pieces.

In the finally mounted state, the closure pieces are fixed axially and radially, as has already been described. In order that mounting of the closure pieces is nevertheless possible when the sealing plate is already attached to the turbine disk, the respective sealing plate comprises at least one recess which interrupts the edge and extends substantially azimuthally on the side which faces the turbine axle. Said recess is designed geometrically in such a way that a closure piece can be inserted into the turbine disk groove, that is to say it is just large enough that a closure piece can be lowered into the turbine disk groove when the sealing plate is already mounted. There, said closure piece can then be displaced azimuthally into its end position, where it is fixed axially by the side wall of the turbine disk groove and the sealing plate and radially by the edge. Further closure pieces can then be inserted via the same recess and can likewise be displaced until all the closure pieces are mounted.

The sealing plates are substantially in the shape of circular sections. As a result, the sealing plates are adapted to the shape of the turbine disk and a reliable seal is therefore ensured. The larger sealing plates in the shape of circular sections then namely cover the same area as the individual sealing plates which previously lay one above another in an overlapping manner.

In a further advantageous refinement, two sealing plates are provided per side face. The simplest refinement of the sealing plates is namely possible in the case of a maximum reduction in the number of sealing plates, one individual sealing plate, for example in the form of a circular ring, not being possible on account of the tilting which is required during mounting. The simplest possible construction is therefore a refinement with two sealing plates of uniform design. In addition, this refinement is advantageous, in particular, for stationary gas turbines, since their assembly of housing and rotor takes place radially and not axially as in the case of airplane gas turbines.

A slot is advantageously made in those faces of two sealing plates which face one another in each case, a metal sheet which connects the slots which lie opposite one another in each case being inserted to seal the intermediate space between the faces. Imbricated overlapping is therefore no longer necessary for a reliable seal between the sealing plates, but rather corresponding slots or grooves are provided with an introduced corrugated sheet. In the case of a suitable design, the latter then closes the remaining small intermediate space between the sealing plates.

The respective sealing plate advantageously has a sealing vane which extends substantially azimuthally and axially.

A seal of that part of the turbine disk which faces the turbine rotor against hot gas penetrating from the interior of the turbine is achieved by a sealing vane of this type which should be of continuous configuration in the azimuthal direction in the case of a correspondingly large sealing plate as a result of the lower number. Here, the sealing vane should extend in the axial direction as far as to the respectively adjacent guide blades, in order to achieve a particular satisfactory seal.

In a further advantageous refinement, the respective closure piece has a hole, the respective sealing plate has a number of notches, and the wall which delimits the turbine disk has a hole for receiving a securing pin. Both the closure pieces and the sealing plate itself can therefore be fixed by a securing pin, and a reliable cohesion is possible with simultaneously simple mounting.

The respective sealing plate is advantageously produced by turning. The lower number of sealing plates namely makes it possible to produce the sealing plates as a circular ring in the turning process and then to divide it. As a result, simplified and less expensive production of the sealing plates is possible.

A gas turbine of this type is advantageously used in a gas and steam turbine system.

The advantages which are associated with the invention comprise, in particular, that a substantially simplified and less expensive construction of the gas turbine is possible as a result of the reduction in the number of sealing plates per side face of the turbine disk. As a result, the design of the entire rotor blade row is simplified substantially and its production is less complicated, since the sealing plates can be produced in the turning process. In addition, the sealing plates have comparatively few leakage faces. As a result, the sealing action can be made substantially tighter in order to reduce the loss of cooling air.

BRIEF DESCRIPTION OF THE DRAWINGS

One exemplary embodiment of the invention will be explained in greater detail using a drawing, in which.

Identical parts are provided with the same designations in all the figures.

DETAILED DESCRIPTION OF INVENTION

Figure 1:
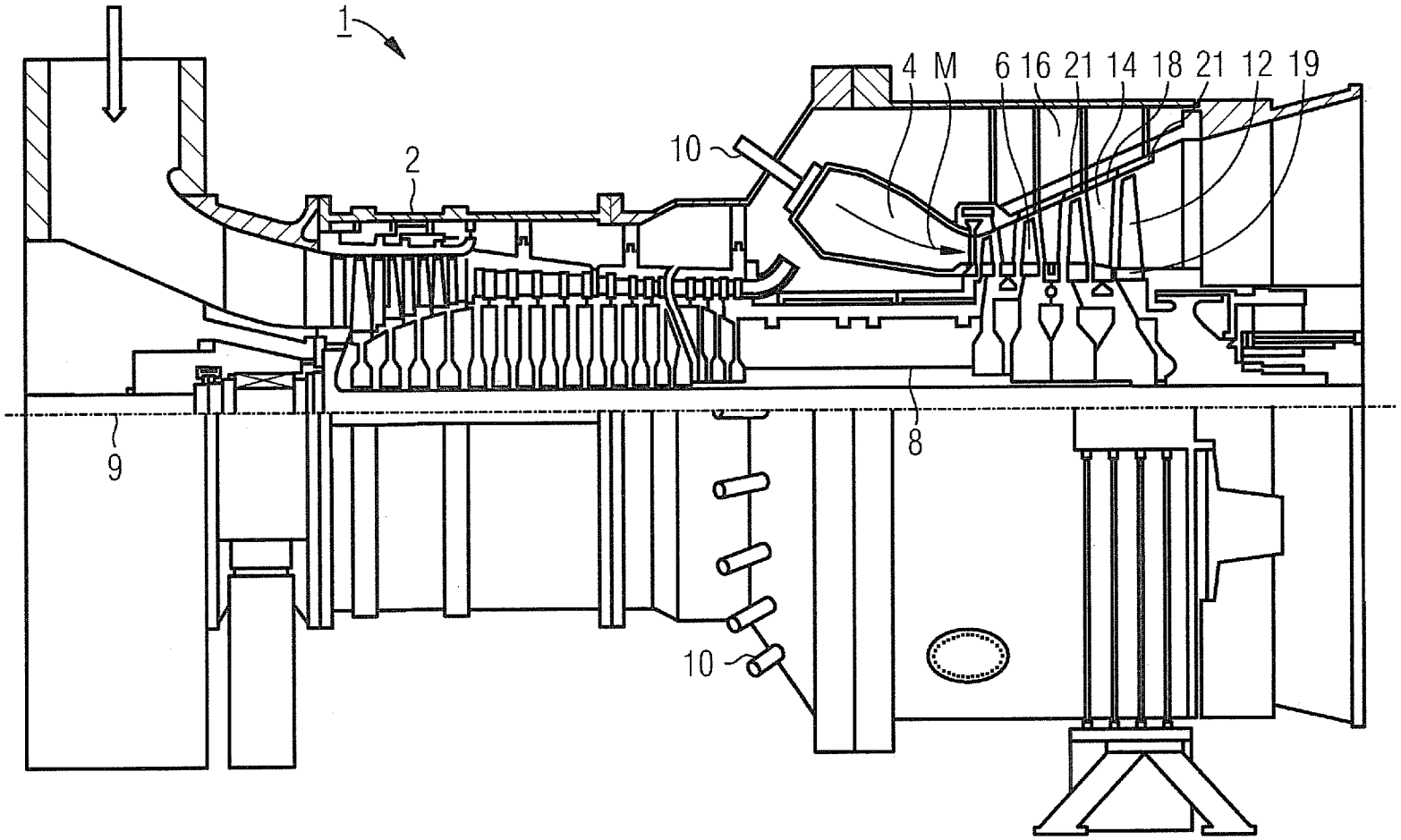
FIG. 1 shows a half section through a gas turbine.

The gas turbine 1 according to FIG. 1 has a compressor 2 for combustion air, a combustion chamber 4 and a turbine unit 6 for driving the compressor 2 and a generator (not shown) or a mobile machine. To this end, the turbine unit 6 and the compressor 2 are arranged on a common turbine rotor 8, to which the generator or the mobile machine is also connected, and which is mounted such that it can rotate about its center axis 9. The combustion chamber 4 which is configured in the manner of an annular combustion chamber is fitted with a number of burners 10 for burning a liquid or gaseous fuel.

The turbine unit 6 has a number of rotatable rotor blades 12 which are connected to the turbine rotor 8. The rotor blades 12 are arranged in an annular manner on the turbine rotor 8 and therefore form a number of rotor blade rows. Furthermore, the turbine unit 6 comprises a number of stationary guide blades 14 which are likewise fastened in an annular manner to a guide blade carrier 16 of the turbine unit 6 with the formation of guide blade rows. Here, the rotor blades 12 serve to drive the turbine rotor 8 by impetus transmission from the operating medium M which flows through the turbine unit 6. In contrast, the guide blades 14 serve to guide the flow of the operating medium M between in each case two rotor blade rows or rotor blade rings which follow one another as viewed in the flow direction of the operating medium M. Here, a pair following one another of a ring of guide blades 14 or a guide blade row and of a ring of rotor blades 12 or a rotor blade row is also called a turbine stage.

Each guide blade 14 has a platform 18 which is arranged as wall element on a guide blade carrier 16 of the turbine unit 6 in order to fix the respective guide blade 14. Here, the platform 18 is a thermally comparatively highly loaded component which forms the outer boundary of a hot gas channel for the operating medium M which flows through the turbine unit 6. Each rotor blade 12 is fastened to the turbine rotor 8 in an analogous manner via a platform 19.

In each case one guide ring 21 is arranged on a guide blade carrier 16 of the turbine unit 6 between the platforms 18, which are arranged spaced apart from one another, of the guide blades 14 of two adjacent guide blade rows. Here, the outer surface of each guide ring 21 is likewise exposed to the hot operating medium M which flows through the turbine unit 6, and is spaced apart in the radial direction by a gap from the outer end of the rotor blades 12 which lie opposite it. Here, the guide rings 21 which are arranged between adjacent guide blade rows serve, in particular, as covering elements which protect the inner housing 16 in the guide blade carrier or other housing installation parts against thermal overloading by the hot operating medium M which flows through the turbine 6.

In the exemplary embodiment, the combustion chamber 4 is configured as what is known as an annular combustion chamber, in which a multiplicity of burners 10 which are arranged around the turbine rotor 8 in the circumferential direction open into a common combustion chamber space. To this end, the combustion chamber 4 in its entirety is configured as an annular structure which is positioned around the turbine rotor 8.

Figure 2:
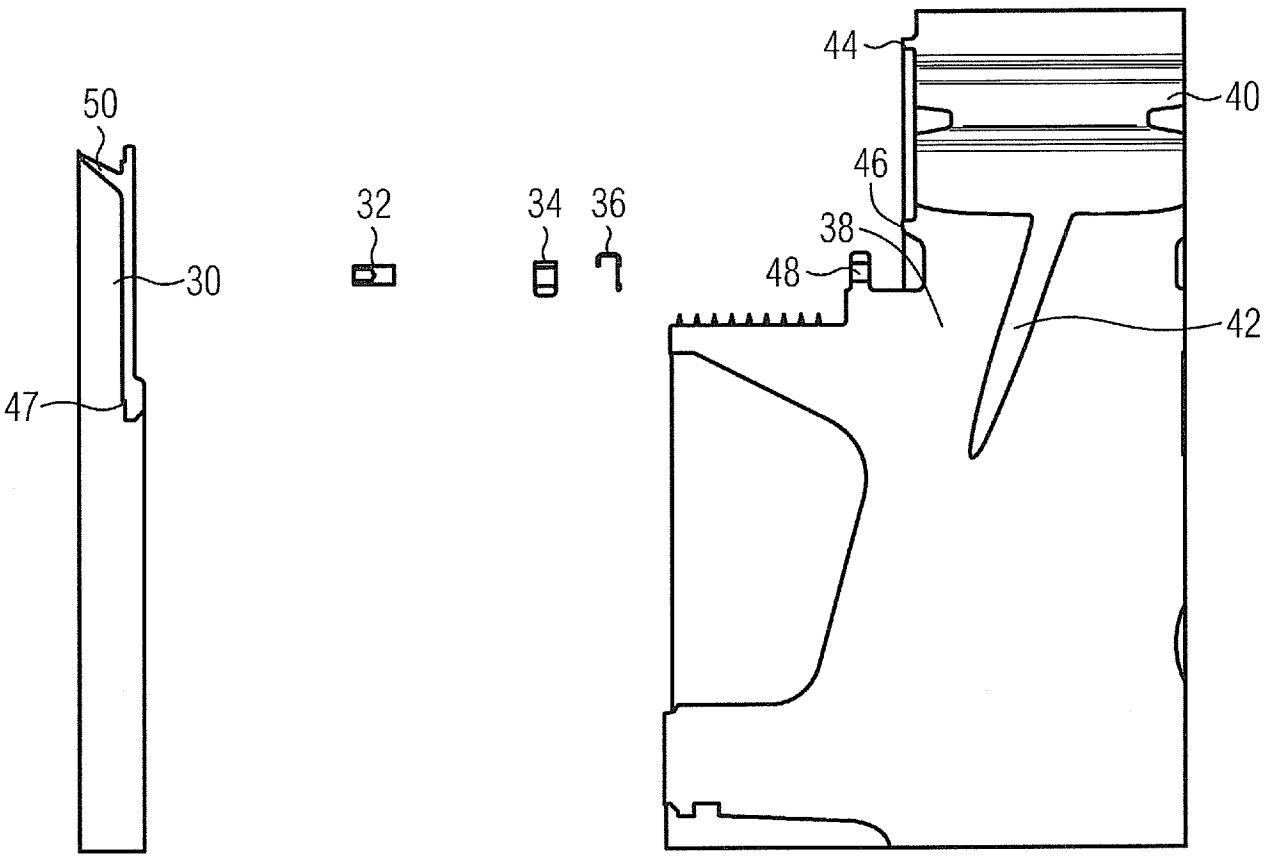
FIG. 2 shows a half section through the outer circumference of a turbine disk for the gas turbine, a sealing plate and its fixing device.

FIG. 2 likewise shows a section through a sealing plate 30, a securing pin 32, a closure piece 34, a securing sheet 36 and through the outer circumference of a turbine disk 38, which is attached to the turbine rotor 8, of a rotor blade stage of the turbine unit 6.

The turbine disk 38 comprises a rotor blade retaining groove 40, in which the rotor blade 12 (not shown) is arranged. Cooling air which cools the turbine disk 36 and is also forwarded into the rotor blade 12 (not shown) is fed through the cooling air hole 42 during the operation of the gas turbine 1.

In order to prevent cooling air from escaping out of the interior of the turbine disk 38 and secondly hot operating medium M from penetrating, the sealing plate 30 is placed onto the side face of the turbine disk 38. Here, cams 44, 46 which are introduced into the turbine disk 38 in a circularly circumferential manner are used as spacer elements. The sealing plate 30 is tilted on the turbine disk 38 by means of the closure piece 34 as a result of an edge 47 which is applied to said sealing plate 30 and extends in the azimuthal direction, and is fixed radially and azimuthally with the securing pin 32 in a hole 48 of the turbine disk 38. Here, the securing sheet 36 prevents the securing pin 32 from being pushed out axially. Here, the edge 47 is set back with respect to an inner edge of the sealing plate 30.

The sealing plate 30 comprises an attached sealing vane 50 which extends substantially in the axial and azimuthal directions and seals the intermediate space between the turbine disk 38 and adjacent guide blades 14 against penetration of hot operating medium M from the turbine. Furthermore, the sealing plate 30 also ensures axial fixing of the rotor blade 12 in the blade root groove 40 and thus secures said rotor blade 12 against displacement.

Figures 3, 4, 5, 6, 7, 8:
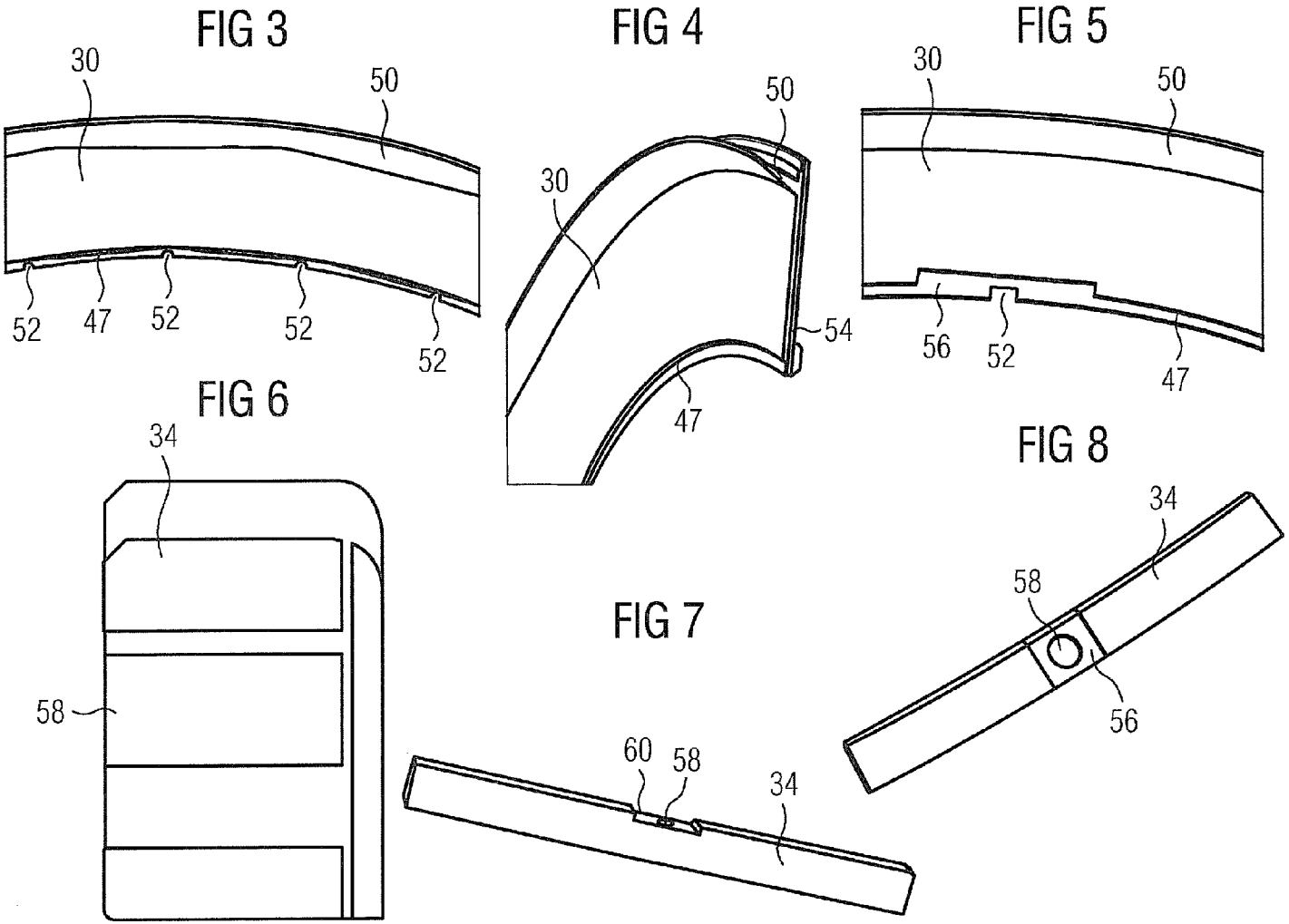
FIGS. 3-5 show a sealing plate in different views.
FIGS. 6-8 show a closure piece in different views.
Figure 10:
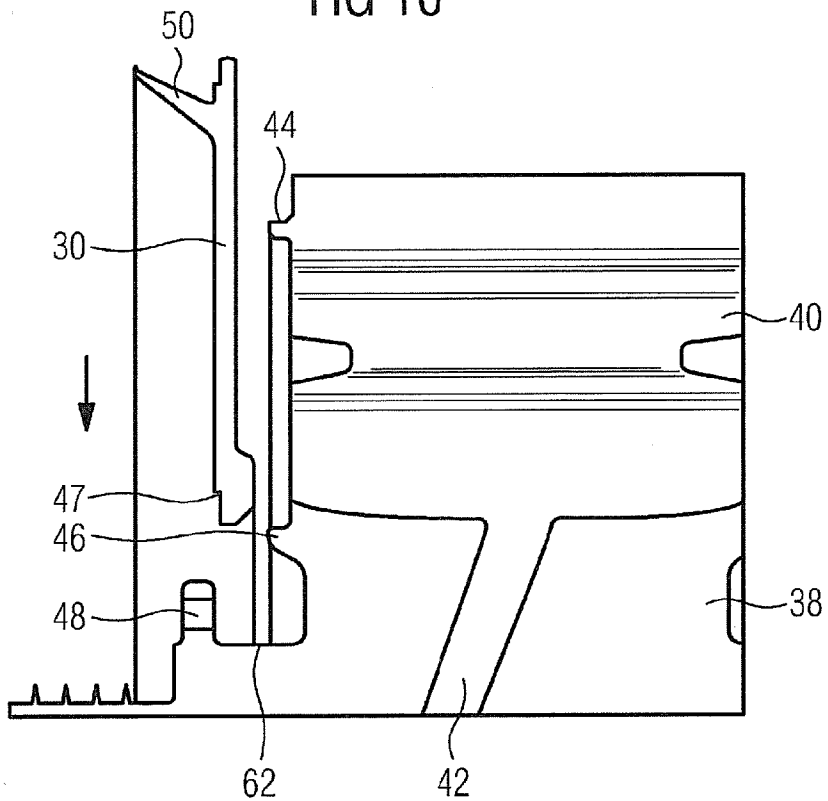
FIGS. 9-14 show the work steps of the mounting process.
Figure 9:
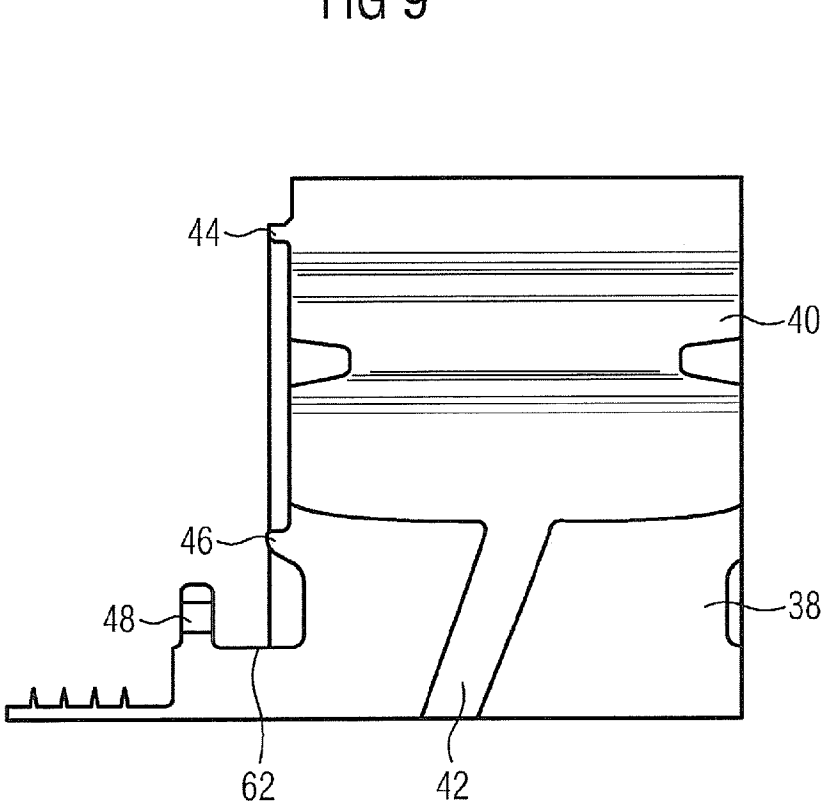
Figure 12:
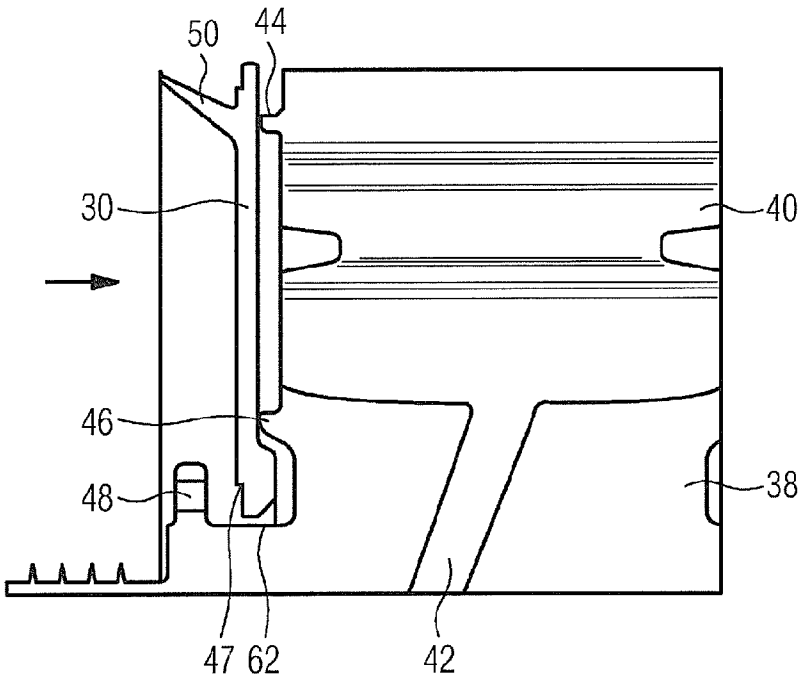
Figure 11:
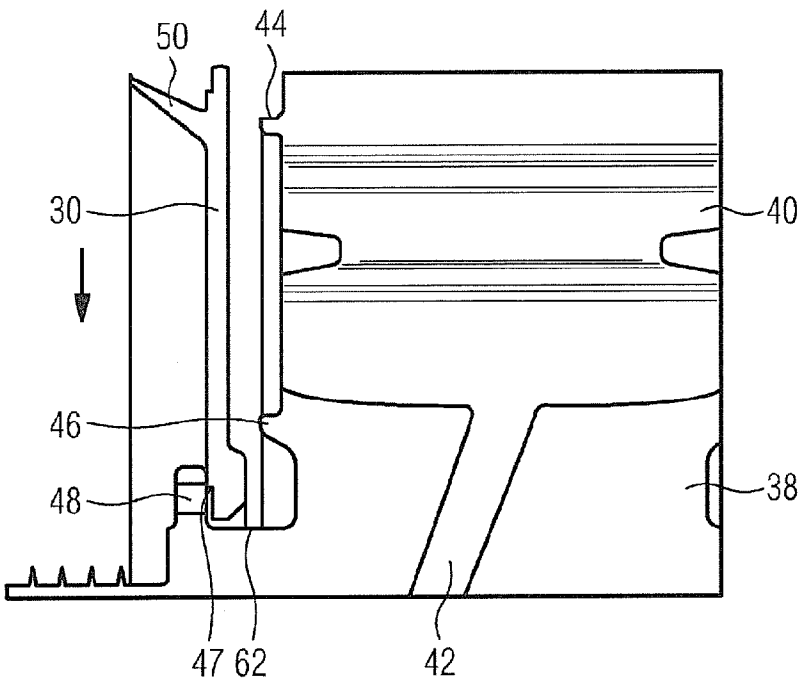

FIG. 3 shows the sealing plate 30 in plan view. Notches 52 are made in the sealing plate 30 at a uniform spacing on the side which faces the turbine rotor 8, which notches 52 serve to receive the securing pins 32. As a result, the sealing plate 30 which is correspondingly larger on account of the overall lower number of sealing plates is fixed along the entire circumference. Furthermore, the edge 47 for fixing the closure pieces 34 can be seen.

FIG. 4 shows the sealing plate 30 in oblique profile. A slot 54 is made in the side face of the sealing plate 30 which bears against a further sealing plate 30 in the mounted state, into which slot 54 a corrugated sheet (not shown) is introduced, with the result that the joint which lies between the sealing plates 30 is closed and is therefore sealed.

FIG. 5 once again shows the sealing plate 30 in plan view. Here, the recess 56 is shown which is made in each case around the notch 52 and interrupts the edge 47. The geometry of said recess 56 is adapted to the size of the closure pieces 34, with the result that said recess 56 is suitable for the insertion of the closure piece 34 which is shown in more detail in the following figures. During the mounting, closure pieces 34 can be lowered through the recess 56 and can subsequently be displaced along the edge 47 into their end position. Fixing of the already mounted sealing plate 30 on the turbine disk 38 and satisfactory sealing of the remaining intermediate space are therefore achieved.

FIG. 6 shows the closure piece 34 in section. A hole 58, into which the securing pin 32 is introduced, is made in the closure piece 34. In FIG. 7 which shows the closure piece 34 in profile, a recess 60 is also shown in addition which serves to receive the securing sheet 36 which prevents the securing pin 32 from being pushed out axially. FIG. 8 once again shows the closure piece in plan view. The adaptation to the shape of the recess 56 which is shown in FIG. 5 can be seen clearly.

Figure 13:
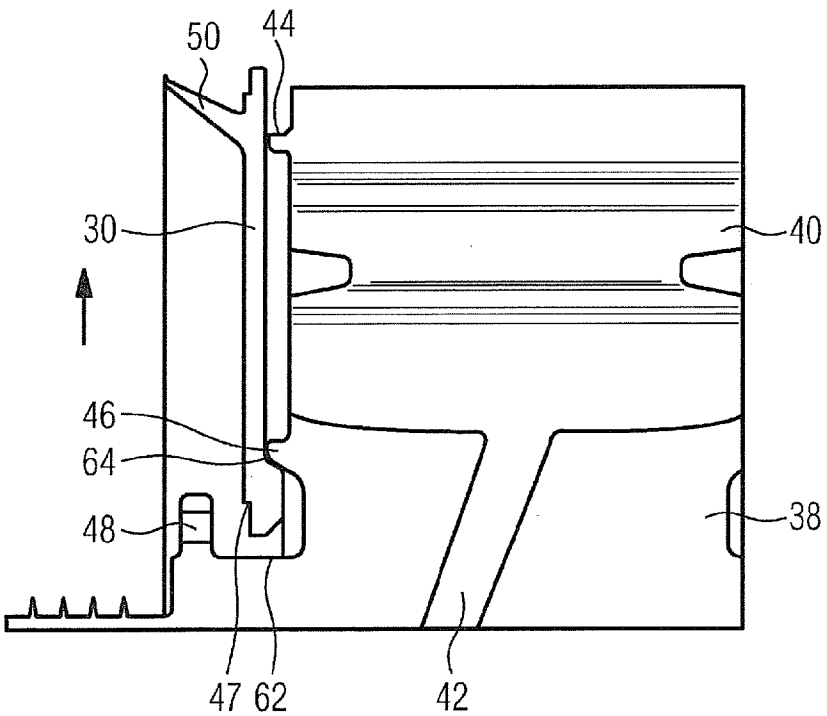

FIG. 9 to FIG. 14 show the mounting process of the sealing plate 30 on the turbine disk 36. First of all, the sealing plate 30 is lowered radially into the turbine disk groove 62 (FIG. 10, FIG. 11), is then moved axially toward the rotor blade 12 (FIG. 12) and finally is raised radially (FIG. 13). The shoulder 64 on the inner radius of the sealing plate 30 therefore bears against the cam 46 of the turbine disk 38. The closure piece 34 is introduced radially into the groove 62 via the recess 56 on the sealing plate 30 and is displaced along the edge 47 in the circumferential direction to such an extent that its hole 58 is aligned with a hole 48 in the turbine disk 38 and a notch 52 in the sealing plate 52. There, the closure piece 34 is fixed with a securing pin 32.

Subsequently, the further closure pieces 34 are inserted on the same path. The sealing plate 30 is therefore secured radially and axially. Furthermore, the closure pieces 47 bear against one another in the mounted state, with the result that a complete seal of the intermediate space between the sealing plate 30 and the side wall of the turbine disk groove 62 is ensured.

Figure 14:
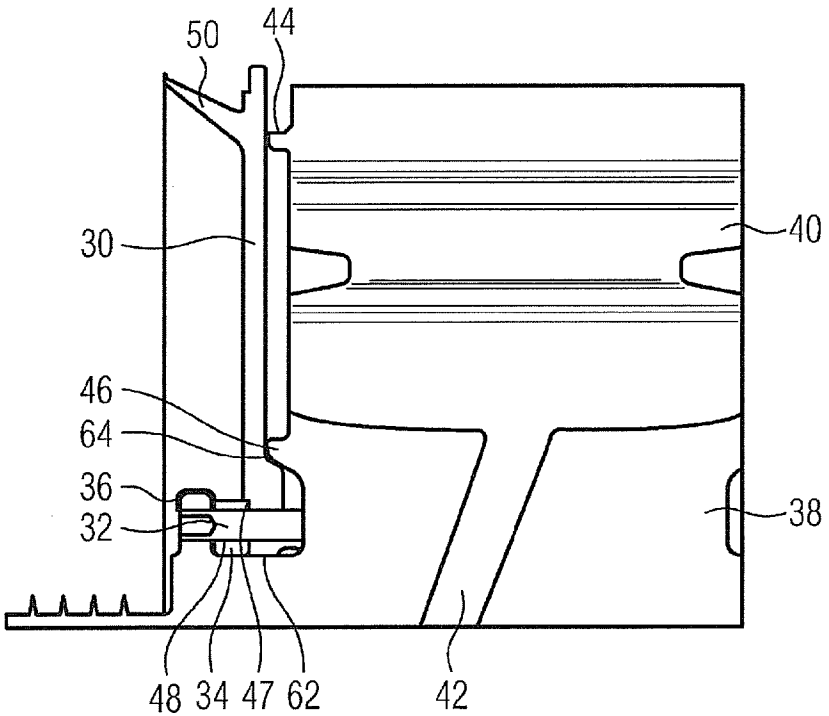

The securing sheet 36 which likewise has a hole centrally is introduced radially into the recess 60 of the closure piece 34. The securing pin 32 is introduced into said hole and the holes 48, 58. Said securing pin 32 secures the securing sheet 36 radially and secures the closure piece 34 and the sealing plate 30 in the circumferential direction. The end of the securing sheet 36 is bent radially downward, to prevent the securing pin 32 being pushed out axially. The final assembly is shown in FIG. 14.

The sealing plate 30 which is shown is substantially semicircularly annular. The sealing plate 30 can therefore be produced as a circular ring using the turning process and subsequently divided. As a result, a particularly simple construction of the gas turbine 1 is possible. Furthermore, a substantially improved seal against the loss of cooling air is possible as a result of the lower number of leakage faces in comparison with the previous overlapping arrangement.

The invention claimed is:

1. A turbine rotor, comprising:

a plurality of rotor blades which are combined in each case to form rotor blade rows and are arranged on in each case one turbine disk, the turbine disk, comprising:

a plurality of sealing plates, on side faces of the turbine disk, in a shape of circularly annular sections which are inserted into an azimuthally extending turbine disk groove, wherein the respective sealing plate includes, on a side which faces a turbine axle, an azimuthally extending edge which is spaced apart from an inner edge of the respective sealing plate, and a closure piece arranged between the edge of the respective sealing plate and a side wall of the turbine disk groove, wherein the edge extends over the entire azimuthal length of the sealing plate and the closure pieces bear against one another in an azimuthal direction for sealing purposes, and wherein the respective sealing plate comprises a recess which extends substantially azimuthally on the side which faces the turbine axle, interrupts the respective edge and is designed geometrically in such a way that the closure pieces are inserted into the turbine disk groove through the recess.

2. The turbine rotor as claimed in claim 1, wherein two sealing plates are provided per side face.

3. The turbine rotor as claimed in claim 2, wherein a slot is made in a plurality of faces of the two sealing plates which face one another in each case, and wherein a metal sheet which connects a plurality of slots which lie opposite one another in each case is inserted to seal an intermediate space between the plurality of faces.

4. The turbine rotor as claimed in claim 1, wherein the respective sealing plate includes a sealing vane which extends substantially azimuthally and axially.

5. The turbine rotor as claimed in claim 1, wherein the respective closure piece includes a first hole, wherein the respective sealing plate includes a plurality of notches, and wherein the side wall which delimits the turbine disk groove includes a second hole for receiving a securing pin.

6. The turbine rotor as claimed in claim 1, wherein the respective sealing plate is produced by turning.

7. A gas or steam turbine system, comprising:

a turbine rotor, comprising:

a plurality of rotor blades which are combined in each case to form rotor blade rows and are arranged on in each case one turbine disk, the turbine disk, comprising:

a plurality of sealing plates, on side faces of the turbine disk, in a shape of circularly annular sections which are inserted into an azimuthally extending turbine disk groove, wherein the respective sealing plate includes, on a side which faces a turbine axle, an azimuthally extending edge which is spaced apart from an inner edge of the respective sealing plate, and a closure piece arranged between the edge of the respective sealing plate and a side wall of the turbine disk groove, wherein the edge extends over the entire azimuthal length of the sealing plate and the closure pieces bear against one another in an azimuthal direction for sealing purposes, and wherein the respective sealing plate comprises a recess which extends substantially azimuthally on the side which faces the turbine axle, interrupts the respective edge and is designed geometrically in such a way that the closure pieces are inserted into the turbine disk groove through the recess.

8. The gas or steam turbine system as claimed in claim 7, wherein two sealing plates are provided per side face.

9. The gas or steam turbine system as claimed in claim 8, wherein a slot is made in a plurality of faces of the two sealing plates which face one another in each case, and wherein a metal sheet which connects a plurality of slots which lie opposite one another in each case is inserted to seal an intermediate space between the plurality of faces.

10. The gas or steam turbine system as claimed in claim 7, wherein the respective sealing plate includes a sealing vane which extends substantially azimuthally and axially.

11. The gas or steam turbine system as claimed in claim 7, wherein the respective closure piece includes a first hole, wherein the respective sealing plate includes a plurality of notches, and wherein the side wall which delimits the turbine disk groove includes a second hole for receiving a securing pin.

12. The gas or steam turbine system as claimed in claim 7, wherein the respective sealing plate is produced by turning.

* * * * *